United States Patent [19]

Badesha et al.

[11] 4,432,841

[45] Feb. 21, 1984

[54] PREPARATION OF CHALCOGENIDE ALLOYS BY ELECTROCHEMICAL COREDUCTION OF ESTERS

[75] Inventors: Santokh S. Badesha, Ontario; Thomas W. Smith, Penfield, both of N.Y.; Rafik O. Loutfy, Ontario, Canada

[73] Assignee: Xerox Corporation, Stamford, Conn.

[21] Appl. No.: 509,550

[22] Filed: Jun. 30, 1983

[51] Int. Cl.[3] ..... C25B 1/00

[52] U.S. Cl. ..... 204/14 N; 204/56 R; 204/59 M

[58] Field of Search ..... 204/59 R, 59 M, 56 R, 204/14 N, 56 R

[56] References Cited

U.S. PATENT DOCUMENTS 4,376,016 3/1983 Fawcett et al. ..... 204/14 N 4,376,682 3/1983 Fawcett et al. ..... 204/14 N

OTHER PUBLICATIONS

Reid et al., J. Elec. Chem. Soc., vol. 104, pp. 21–29, Jan. 1957.

*Primary Examiner*—F. Edmundson

*Attorney, Agent, or Firm*—E. O. Palazzo

[57] ABSTRACT

This invention is generally directed to a process for preparing chalcogenide alloys of high purity which comprises providing the corresponding pure esters of the elements desired in an organic medium, and an organic salt followed by simultaneously coreducing the esters by an electrochemical reduction in an electrolytic apparatus. More specifically, in one embodiment, selenium arsenic, alloys of high purity are prepared by subjecting the corresponding pure esters to a simultaneous electrochemical reduction reaction in an electrochemical apparatus containing an anode, a cathode, an electrolytic solution comprised of the pure esters of selenium and arsenic, contained in a solution of an organic solvent, and an organic salt wherein the pure esters lose electrons resulting in the desired metallic alloys.

21 Claims, No Drawings

PREPARATION OF CHALCOGENIDE ALLOYS BY ELECTROCHEMICAL COREDUCTION OF ESTERS

BACKGROUND OF THE INVENTION

This invention is generally directed to processes for the preparation of alloys, and more specifically, the present invention is directed to the preparation of chalcogenide alloys in high purity by simultaneously electrochemically coreducing the esters of the desired elements. In one embodiment of the present invention, for example, arsenic selenium alloys of a high purity, 99.99 percent, are obtained by simultaneously coreducing by electrochemical means the isolated substantially pure esters of selenium and arsenic. The resulting chalcogenide alloys are useful as imaging members, particularly xerographic photoconductive members in electrostatic imaging systems.

The incorporation of selenium or selenium alloys into xerographic imaging members is well known. These members can be subjected to a uniform electrostatic charge for the purpose of sensitizing the surface of the photoconductive layer, followed by exposure of an image to activating electromagnetic radiation such as light, which exposure selectively dissipates the charge in the illuminated areas of the photoconductive insulating member, and wherein a latent electrostatic image is formed in the non-illuminated areas. The resulting image may then be developed and rendered visible by depositing thereon toner particles containing resin particles and pigment particles.

Recently, there has been described layered organic and inorganic photoresponsive devices containing amorphous selenium, trigonal selenium, amorphous selenium alloys, or halogen doped selenium alloys. One such photoresponsive member is comprised of a substrate, a photogenerating layer containing metal phthalocyanine, metal free phthalocyanine, vanadyl phthalocyanine, or selenium tellurium alloys, and a transport layer containing a diamine dispersed in a resinous binder, reference U.S. Pat. No. 4,265,990.

Commercially available selenium or selenium alloys for use in electrostatic imaging systems, including the use of these materials in an imaging apparatus containing layered organic or layered inorganic photoresponsive devices are generally substantially pure, that is, for example a purity of 99.99 percent or greater is desired, since the presence of impurities has a tendency to adversely effect the imaging properties of selenium, including the electrical properties thereof, causing copy quality obtained from such devices to be relatively poor in comparison to devices wherein high purity selenium is used.

Many processes are known for the preparation of chalcogenide alloys, particularly selenium containing alloys including, for example, melt blending of the elemental substances such as selenium and arsenic in the proportions desired in the final alloy product. Thus, for example, there is disclosed in U.S. Pat. No. 3,634,134 the preparation of arsenic-selenium alloys by mixing a master alloy containing the appropriate proportions of arsenic and selenium. This method not only involves high temperatures, but in most instances, crystalline materials are not obtained. Further, in many instances, depending on the process parameters, the desired alloy does not result rather, by following the melt blending process, there is obtained a homogenous mixture of arsenic, selenium, and an arsenic selenium alloy. Additionally, in these processes, there must be selected for evaporation, high purity arsenic and high purity selenium, that is 99.99 percent pure, and processes for obtaining high purity arsenic and selenium precursors require undesirable high temperature distillations. A similar melt blending method for preparing selenium alloys is disclosed in U.S. Pat. No. 3,911,091.

Also there is disclosed in U.S. Pat. No. 4,007,255 a process for preparing stable red amorphous selenium containing thallium by precipitating selenious acid containing from about 10 parts per million to about 10,000 parts per million of thallium dioxide, with hydrazine from a solution thereof in methanol or ethanol containing not more than about 50 percent by weight of water at a temperature between about −20 degrees Centigrade and the freezing point of the solution wherein the resulting precipitate is maintained at a temperature of from about a −13 degrees Centigrade to about a −3 degrees Centigrade. Additionally U.S. Pat. No. 4,009,249 contains a similar disclosure with the exception that thallium is not contained in the material being treated.

Further disclosed in U.S. Pat. No. 3,723,105 is a process for preparing a selenium-tellurium alloy by heating a mixture of selenium and tellurium containing 1 to 25 percent by weight of tellurium to a temperature not lower than 350 degrees Centigrade causing the mixture to melt, followed by cooling gradually the molten selenium and tellurium to around the melting point of the selenium tellurium alloy at a rate not higher than 100 degrees Centigrade per hour, and subsequently quenching to room temperature within 10 minutes.

Additionally, there is disclosed in U.S. Pat. No. 4,121,981 the preparation of a selenium alloy by, for example, electrochemically codepositing selenium and tellurium onto a substrate from a solution of their ions wherein the relative amount of alloy deposited on the cathode is controlled by the concentrations of the selenium and the tellurium in the electrolyte, and by other electrochemical conditions. When the selenium tellurium layer deposited on the cathode has achieved the desired thickness, deposition is discontinued and the cathode is removed. Further, there is disclosed in U.S. Pat. No. 4,192,721 the preparation of metal chalcogenides by depositing at low current densities these materials as a smooth film on a cathod by an electroplating process. As the electrolyte there is selected for this process a metal salt dissolved in an organic polar solvent, and in which there is also dissolved the chalcogen in elemental form.

Moreover there is disclosed in U.S. Pat. No. 2,649,409, the electrodeposition of selenium on conducting surfaces. According to the disclosure of this patent selenium may be electrodeposited in its grey metallic form by utilizing an electrodeposition bath containing a supply of quadrivalent selenium cations, that is cations containing selenium in the quadrivalent state such $Se^{+4}$, $SeO^{+2}$. Similarly, there is disclosed in U.S. Pat. No. 2,649,410 the manufacturing of selenium rectifiers, selenium photocells, and similar devices wherein grey crystalline metallic selenium is electrodeposited on a cathode from an acidic aqueous solution of selenium dioxide. More specifically, in the process described in this patent there is added elemental particles of selenium to an aqueous acidic solution containing selenium dioxide, the particles being added in a quantity greater than the metallic selenium content of the solution, followed by accomplishing an electrodeposition of the resulting treated solution.

Recently, there has been developed simple economical chemical processes for preparing chalcogenide alloys in high purity wherein substantially pure esters of the desired elements are subjected to a reduction reaction, with for example, hydrazine or sulfur dioxide. Details of this process are described in copending application U.S. Ser. No. 405,651, filed Aug. 5, 1982, the disclosure of which is totally incoporated herein by reference.

While the process as described in the copending application is suitable for the purpose intended, there continues to be a need for other suitable processes for preparing chalcogenide alloys of high purity.

Furthermore, there continues to be a need for improved processes for preparing chalcogenide alloys of a purity of 99.99 percent, and wherein the electrical properties of the resulting product can be desirably controlled. Additionally, processes are needed for obtaining chalcogenide alloys of high purity wherein the simultaneous reduction of the corresponding pure esters is not accomplished by chemical means. Moreover, there continues to be a need for the preparation of chalcogenide alloys in high purity by electrochemical methods. Also, there continues to be a need for improved processes for preparing chalcogenide alloys by electrochemical means, wherein the process is accomplished in the presence of an organic medium, and in the absence of an aqueous medium.

OBJECTS OF THE INVENTION

It is an object of the present invention to provide processes for preparing chalcogenide alloys of high purity which overcome the above-noted disadvantages.

In another object of the present invention there is provided improved processes for preparing chalcogenide alloys of high purity by simultaneously subjecting the corresponding pure esters to an electrochemical reduction reaction.

In a further object of the present invention there is provided improved processes for the preparation of selenium alloys by simultaneously electrochemically coreducing the corresponding pure selenium esters, and pure tellurium esters in the presence of an organic medium.

In yet another object of the present invention there are provided improved processes for obtaining chalcogenide alloys in high purity, including alloys of selenium and tellurium, and selenium and arsenic, wherein essentially no pollutants are emitted and complex extensive high temperature heating apparatus, such as quartz are not needed.

In a further object of the present invention there is provided improved electrochemical reduction processes for preparing chalcogenide alloys wherein the use of undesireable high vacuum conditions are eliminated.

These and other objects of the present invention are accomplished by the provision of an improved process for the preparation of chalcogenide alloys of high purity, which comprises the simultaneous electrochemical reduction of the corresponding pure metallic esters. More specifically, in one embodiment, the present invention is directed to an improved electrochemical process for preparing chalcogenide alloys of high purity, including alloys of selenium arsenic, selenium tellurium, selenium tellurium arsenic, selenium tellurium sulfur, and the like, by subjecting the corresponding pure esters containing the elements involved to an electrochemical reduction reaction in the presence of an organic medium, and an organic acid. In one variation of the process of the present invention, the esters of the desired elements are formed by treating the corresponding oxides with an alcohol or glycol, followed by subjecting the isolated esters subsequent to purification to an electrochemical coreduction process. Thus, the esters can be obtained by treating the oxides of the elements of Groups VA and VIA of the periodic table with an alcohol, or diol which esters are subsequently purified and simultaneously reduced in a known electrochemical appartus. Specifically for example pure selenium esters are obtained by the condensation reaction of selenium oxide with an alcohol, while the corresponding esters of other elements such as arsenic, antimony, bismouth, and tellurium are usually formed by reacting the corresponding oxides with a glycol or by treatment of the oxides with an alcohol such as methanol, and the corresponding alkoxides, such as sodium methoxide. Subsequently, the resulting chalcogenide esters are purified by distillation recrystallization, or similar known purification methods, and thereafter simultaneously electrochemically coreduced so as to result in chalcogenide alloys of high purity.

DESCRIPTION OF THE PREFERRED EMBODIMENTS

Generally the process of the present invention involves subjecting a mixture of high purity chalcogenide esters to a simultaneous electrochemical coreduction reaction in order to obtain an alloy of the desired composition in high purity. The preparation of these esters, which are described in copending applications involve the reaction of the oxides of Groups V to VIA of the Periodic Table with an alcohol or glycol. The resulting mixture of chalcogenide esters, subsequent to purification are then subjected to a simultaneous electrochemical reduction reaction in a known electrochemical system.

The process of the present invention will now be described with reference to the following illustrative preferred embodiments, however, process conditions, parameters and reactants other than those specified can be selected for the process of the present invention providing the objectives thereto are achieved. Accordingly, it is not intended to be limited to the process conditions, electrochemical reaction conditions, and the like that follow.

Prior to accomplishing the electrochemical reduction in accordance with the process of the present invention, there is initially prepared the substantially pure corresponding esters. Thus, for example, the selenium ester, $(RO)_2SeO$ wherein R is an alkyl group, is prepared as described in copending application U.S. Ser. No. 404,259, the disclosure of which is totally incorporated herein by reference. In one method of preparation, selenous acid $H_2SeO_3$ is reacted with an alcohol, ROH, wherein R is an alkyl group containing from 1 carbon atom to about 30 carbon atoms, and preferably from 1 carbon atom to about 6 carbon atoms. Water resulting from this reaction can be optionally removed by an azeotropic distillation, to yield the pure liquid diethyl selenite ester $(RO)_2SeO$ after vacuum distillation.

Illustrative examples of alcohols selected for obtaining the desired high purity selenium ester include those as described in the referenced copending application, such as methanol, ethanol, propanol, butanol, pentanol, hexanol, and octanol. The preferred alcohols selected for forming the selenium ester include methanol, ethanol, and propanol.

More specifically, the selenium ester is obtained by subjecting a crude selenium material, available from Fisher Scientific Company, to an oxidation reaction, by dissolving this material in a strong acid, such as nitric acid. As strong acids, there can be selected commercially available concentrated nitric acid, commercially available concentrated sulfuric acid, and mixtures thereof. When mixtures of acids are selected generally from about 20 percent of sulfuric acid and about 80 percent of nitric acid are used, however percentage mixtures can range from between about 5 percent sulfuric acid to about 95 percent nitric acid, and preferably from about 10 percent sulfuric acid to about 90 percent nitric acid. The preferred acid is nitric acid, primarily since it is a stronger oxidizing acid for selenium. Other chemical reagents such as hydrogen peroxide, molecular oxygen, and the like, can also be used to effect this conversion.

Usually the crude material which is about 98 percent pure, contains a number of impurities, such as arsenic, bismuth, cadmium, chromium, iron, sodium, magnesium, lead, antimony, tin, silicon, titanium, nickel, lead, thallium, boron, barium, mercury, zinc, other metallic and non-metallic impurities, and the like.

The amount of crude selenium to be dissolved can vary depending for example, on the amount of high purity product desired. Normally from about 1 pound to about 1.5 pounds of crude selenium are dissolved, and preferably from about 1 pound to about 500 grams are dissolved, however it is to be appreciated that substantially any effective amount of crude selenium can be dissolved if desired.

Generally, the acid used for dissolving the crude selenium product is added thereto in an amount of from about 600 milliliters to about 1,200 milliliters, and preferably from about 800 milliliters to about 900 milliliters for each pound of selenium being dissolved.

The resulting suspension of selenium and acid are stirred at a sufficient temperature so as to cause complete dissolution of the crude selenium. In one specific embodiment, the suspension is continuously stirred at a temperature of between about 65 degrees centigrade to about 85 degrees centigrade for a sufficient period of time to cause complete dissolution of the crude selenium, as noted by the formation of a clear solution. This solution is usually formed in about 1 hour to about 3 hours, however the time can vary significantly depending on the process parameters selected. Thus, for example, very extensive stirring at higher temperatures will result in complete dissolution of the crude selenium in about an hour or less, while low temperatures, less than 30 degrees Centigrade, and slow stirring will not cause the crude selenium to be dissolved until about 3 hours or longer.

Thereafter, the concentrated acid mixture is separated from the resulting clear solution by a number of known methods including distillation at the appropriate temperature, for example 110 degrees Centigrade when nitric acid is being separated. The resulting separated acid can be collected in a suitable container, such as distillation receiver, and subsequently recycled and repeatedly used for dissolving the crude selenium product.

Subsequent to the distillation reaction, and separation of the acid from the solution mixture, there results a white powder, identified as selenous acid $H_2SeO_3$, and other oxides of selenium, such as selenium dioxide. To this powder there is then added an aliphatic alcohol of the formula ROH, wherein R is an alkyl group containing from 1 to about 30 carbon atoms, and preferably from about 1 to about 6 carbon atoms or a diol, causing the formation of a liquid selenium ester. Generally from about 500 milliliters to about 800 milliliters, and preferably from about 600 milliliters to about 700 milliliters of aliphatic alcohol, or diol, are utilized for conversion to the selenium ester, however, other appropriate amounts of alcohol can be selected.

Water formed subsequent to the addition of the aliphatic alcohol or diol, can be removed if desired by an azeotropic distillation process. This is accomplished by boiling the mixture with various azeotropic substances, such as aliphatic and aromatic hydrocarbons including toluene, benzene and pentane. The known azeotropic distillation processes can be effected at temperatures at which the azeotropic agent begins to boil, thus when pentane is used this temperature ranges from about 30 degrees centigrade to about 35 degrees centigrade. While it is not necessary to azeotropically remove water from the reaction mixture, since the purity of the resulting selenium product will not be adversely affected, it is preferred in the process of the present invention to cause this removal in order, for example, that higher yields of product might be obtained.

The complete removal of water and thus total conversion to the selenium ester is generally accomplished in a period of from about 8 to about 10 hours.

The excess aliphatic alcohol and hydrocarbons, if any, selected for the azeotropic distillation, are then removed by subjecting the resulting reaction mixture to distillation, generally under a vacuum of about 5 millimeters of mercury, and at a temperature of from about 70 degrees Centigrade to about 80 degrees Centigrade. There is then collected, when ethanol is utilized, the pure colorless liquid selenium ester diethyl selenite $(C_2H_5)_2SeO$, as identified by spectroscopic analysis, however, other dialkyl selenite esters can also be obtained with different alcohols.

The tellurium ester is prepared in substantially a similar manner wherein, for example, tellurium oxide is reacted with a cyclic aliphatic or aromatic diol, of the formula HO(R)OH wherein R is a cyclic aliphatic ring, or an aromatic ring, or where the tellurium oxide is reacted with an aliphatic diol of the formula $HO(CR_1R_2)_nOH$ wherein $R_1$ and $R_2$ are independently selected from the group consisting of hydrogen or alkyl groups containing from 1 carbon atom to about 30 carbon atoms, and preferably from 1 carbon atom to about 6 carbon atoms, and n is a number from about 1 to about 10. This treatment generally involves the use of catalysts such as aromatic or aliphatic sulfonic acids, including p-toluene sulfonic acid. In one embodiment the process for preparing a pure tellurium ester involves stirring and heating a mixture of tellurium oxide and diol, in the presence of a catalyst for a period of time sufficient so as to result in a clear solution. The resulting crystalline tetraalkoxytellurane tellurium ester is generally identified by spectroscopic and analytical techniques. Also, the tetraalkoxytelluranes can be prepared by the condensation of tellurium tetrachloride with alkoxides, in the presence of corresponding alcohols, resulting in an ester of the formula $(R_3O)_4Te$ wherein $R_3$ is an alkyl group.

Examples of aliphatic diols selected for reaction with the tellurium oxide are ethylene glycol, 1,2 or 1,3-propane diol, propylene glycol, butylene glycol, 1,2 1,3, or 1,4-butane diols, analogous hexane diols, and the like, with ethylene glycol being preferred. Examples of aromatic diols include catechol, resorcinol, 1,2-naphthalene diol, 1,3-naphthalene diol, with resorcinol being preferred.

The pure tellurium esters obtained from the condensation reaction of tellurium dioxide with an aliphatic or aromatic diol are generally of the following formula:

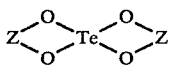

wherein Z is a cyclic or acyclic aliphatic or aromatic group. In those situations where ethylene glycol or catechol are selected as the diols for reaction, the resulting pure tetraalkoxy telluranes will be of the following formulas, respectively,

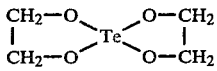

and

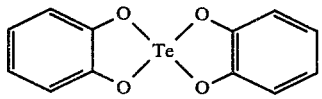

More specifically, preparation of the tellurium esters is accomplished as described in copending application U.S. Ser. No. 404,257 the disclosure of which is totally incorporated herein by reference. In one very specific embodiment, a tellurium ester is prepared by initially dissolving commercial grade tellurium in a strong acid, such as concentrated nitric acid, resulting in a solution of tellurium oxides. Subsequently, the resulting oxides are reacted with an appropriate glycol.

As strong acids there can be selected commercially available concentrated nitric acid, commercially available concentrated sulfuric acid, and mixtures thereof. When mixtures of acids are selected, generally from about 20 percent of sulfuric acid and about 80 percent of nitric acid are used, however percentage mixtures can range from between about 5 percent sulfuric acid to about 95 percent nitric acid, and preferably from about 10 percent of sulfuric acid to about 90 percent of nitric acid. The preferred acid is nitric acid, primarily since it is a strong oxidizing acid for the tellurium.

Generally, nitric acid used for dissolving the crude tellurium product is added thereto in an amount of from about 600 milliliters to about 1,200 milliliters, for each pound of tellurium being dissolved, and preferably from about 800 milliliters to about 900 milliliters.

The resulting suspension of tellurium and acid are stirred at sufficient temperature so as to cause complete dissolution of the crude tellurium. In one specific embodiment, the suspension is subjected to extensive stirring; and the mixture is heated to a temperature not exceeding 110 degrees Centigrade, for a sufficient period of time until complete dissolution occurs. Generally, the crude tellurium will be completely dissolved in a period ranging from about 6 hours to about 10 hours. The unreacted nitric acid can then be removed from the reaction mixture, by distillation at the boiling point of the acid, or acid mixture, which generally ranges from about 100 degrees Centigrade to about 110 degrees Centigrade. The separated acid can then be collected in a receiver and recycled for subsequent use in the reaction.

Subsequently, the tellurium oxide obtained is reacted with diol, such as a glycol in the presence of a catalyst such as para-toluene sulfonic acid, wherein there results a tetraalkoxytellurane ester. The amount of glycol and catalyst, such as para-toluene sulfonic acid selected is dependent on a number of factors including the amount of tellurium oxide formed. Generally, however, from about 1 to about 3 liters of glycol, and from about 5 to about 10 grams of catalyst, such as para-toluene sulfonic acid are used, for each pound of tellurium oxide being treated.

Other catalysts can be selected for assisting in the reaction of the tellurium oxide with the glycol, such catalysts including aliphatic and aromatic sulfonic acids, other than para-toluene sulfonic acid, mineral acids, such as sulfuric acid, acetic acid, hydrochloric acid, and the like. Additionally, other similar equivalent catalysts can be utilized providing the objectives of the present invention are achieved.

Thereafter, the tetralkoxy tellurane esters are separated as solids, which can be purified by recrystallization, or as liquids, wherein purification is accomplished by distillation. The isolated pure ester is then subjected to a low temperature reduction reaction as described hereinafter.

As an optional step in the process, any water formed by the reaction of the tellurium oxides with the glycol can be azeotropically removed by distillation with various aliphatic and aromatic azeotropic agents such as pentane, cyclohexane, toluene and benzene. The temperature of the azeotropic reaction will vary depending on the azeotropic material selected, thus for toluene, the azeotropic distillation is accomplished at a temperature of from 34 degrees Centigrade to about 95 degrees Centigrade, while for benzene the temperature used is from about 60 degrees Centigrade to about 68 degrees Centigrade. Generally, complete removal of water occurs in about 8 to about 10 hours, thus allowing substantially complete conversion of the tellurium oxide to the corresponding tellurium ester, tetraalkoxytellurane $Te(OCH_2CH_2O)_2$. It is not necessary to remove water from the reaction mixture since the purity of the resulting tellurium substance will not be adversely affected, however, it is believed that higher yields of tellurium will be obtained with the removal of water, although this may not necessarily the situation under all reaction conditions.

The high purity arsenic ester can be prepared in substantially the same manner described herein with regard to the preparation of the tellurium ester. Thus, for example, the arsenic ester, bis(arsenic triglycollate) of the formula $$(OCH_2)_2As.O.CH_2CH_2O.As(OCH_2)_2$$

can be prepared by treating arsenic oxide ($As_2O_3$), with ethylene glycol in the presence of a catalyst such as p-toluene sulfonic acid. Other arsenic esters may also be selected for the process of the present invention including arsenic alkoxides of the general formula $As(OR)_3$ wherein R is as defined herein. The arsenic alkoxides are generally prepared by reacting arsenic trichloride with sodium alkoxides in the presence of the corresponding alcohols. For example, such a reaction is illustrated by the following equation:

$$AsCl_3 + ROH \xrightarrow{NaOR} As(OR)_3$$

The resulting arsenic esters are soluble in organic solvents such as cellosolve.

Similarly, the corresponding sulfur ester dialkyl sulfite which is commercially available can be prepared by the reaction of thionyl chloride with an alcohol. For example, dimethyl sulfite, can be prepared by the condensation reaction of thionyl chloride with methanol in accordance with the following equation:

$$SOCl_2 + CH_3OH \rightarrow (CH_3O)_2SO$$

The electrochemical reduction reaction is then accomplished in a known electrolytic appartus containing an anode, a cathode, a power source for the appartus, and an electrolytic solution containing the pure esters, in an organic media, and an organic salt.

The electrochemical reduction reaction generally occurs at various current densities, however, in one embodiment, this density ranges from about 1 microamper/cm$^2$, to about 1 amper/cm$^2$, and preferably from about 100 microamper/cm$^2$ to about 0.1 amper/cm$^2$. Other current densities can be selected providing the objectives of the present invention are achieved.

Various known anode materials can be selected for use in the electrochemical cell, including carbon, graphite, gold, platinum, steel, nickel, titanium, ruthinized titanium, indium/tin oxides, and the like. Other anode materials can be selected providing for example, that they do not dissolve substantially the electrolytic solution.

Illustrative examples of useful cathode materials include indium/tin oxides, tin oxide, carbon, steel, nickel, titanium, nobel metals such as gold, platnium, palladium, chromium, and the like. Furthermore, cathode materials which contain various substrates, such as plastic sheets, webs or aluminum drums, coated with the aforementioned metals, especially chromium or titanium coated aluminum sheets or drums can be selected.

Preferred anode material useful in the process of the present invention are graphite, stainless steel, and ruthenium oxide, while preferred cathode materials include indinium tin oxide, chromium, and titanium, primarily because of their commercial availability and their inertness to the electrolytic solution.

The electrolytic solution is comprised of various known organic solvents, such as cellosolve, glycols, glymes dimethylsulfoxide, dimethylformamide, acetonitrile, propylenecarbonate, and various other known electrochemical solvents. Additionally included in the solution are known electrolytic organic salts, such as tetraalkyl ammonium salts, tetraethyl ammonium salts, tetrabutyl ammonium perchlorate, tetrafluoroborates, and the like, wherein the alkyl groups contains from about 2 carbon atoms to about 7 carbon atoms. Other electrolytic solvents salts such as as ammonium chloride, and lithium chloride, can be incorporated into the electrlytic solution. The esters to be reduced in accordance with the process of the present invention are dissolved in the solution mixture of organic solvent, and organic salt.

While various ratios of components can be included in the electrolytic solution, depending for example on the ester being reduced, generally from about 100 milliliters of organic solvent and one gram of organic salt to one to ten grams of selenium ester or arsenic ester, and 0.01 to one gram of tellurium ester are selected. Also for example from about 1,000 milliliters of organic solvent and ten grams of organic salt to ten to 100 grams of selenium ester or arsenic ester, and 0.1 to ten grams of tellurium ester can be used.

Subsequent to completion of the electrochemical reaction, the resulting pure alloys are formed at the cathode of the electrochemical cell, while there is formed at the anode unidentified oxidation products. The amount of alloy deposited depends on a number of factors including the current density selected and the time of deposition. Generally, this amount is from about 0.01 microns to about 1.0 microns, when the current density ranges from about $5\times10^{-5}$ amps per centimeter squared to about $10\times10^{-3}$ amps per centimeter squared and the time of deposition ranges from about one minute to about ten minutes. Preferably the amount deposited is from about 0.10 microns to about 0.5 microns when the current density ranges from about $5\times10^{-4}$ A/cm$^2$ to about $1\times10^{-3}$ A/cm$^2$ and the time of deposition ranges from about 10 minutes to about 40 minutes.

In one embodiment of the process of the present invention, the cathode can be removed from the cell, and the films of chalcogenide alloy deposited thereon can be recovered by scrapping with a metal rod followed by washing with water methanol and acetone. The resulting product was then dried.

In another variation of the process of the present invention the cathode material can be comprised of a drum such as aluminum, overcoated with a thin film of titanium, chromium or indium tin oxide wherein the chalcogenide alloy is deposited on this drum. Accordingly, when the cathode material is removed from the electrochemical cell, there is no need to scrape from the drum the deposited chalcogenides. Rather, the drum can be washed with water, methanol and acetone then subsequently selected for use in a xerographic imaging system.

The chalcogenide films deposited on the cathode can be identified by a number of known methods, including x-ray diffraction analysis.

Illustrative examples of specific alloys prepared in accordance with the process of the present invention, which alloys are of a purity of 99.99, or greater, include $As_2Se_3$, $As_2Se_{2.7}Te_{0.3}$, $Se_{40}Te_1$, and the like.

The alloys prepared in accordance with the process of the present invention can be formulated into imaging members by, for example, depositing such alloys on a suitable conductive substrate such as chromium or titanium coated aluminum. The resulting imaging or photoconductive member can then be incorporated into an electrostatographic imaging system such as a xerographic imaging system wherein the imaging member is charged to a suitable polarity, followed by developing the resulting latent image with a toner composition comprised of resin particles and pigment particles, and transferring the developed image to a suitable substrate such as paper, and optionally permanently affixing the image thereto. Furthermore, the alloys prepared in accordance with the process of the present invention can be utilized in layered photoresponsive devices as the generating layer. Such devices usually consist of a conductive substrate, a generating layer, and a transport layer, reference U.S. Pat. No. 4,265,990, the disclosure of which is totally incorporated herein by reference.

The following examples specifically defining preferred embodiments of the present invention are now provided, which examples are not intended to limit the scope of the present invention, it being noted that various alternative parameters which are not specifically mentioned are included within the scope of the present invention. Parts and percentages are by weight unless otherwise indicated.

EXAMPLE I

This example describes the preparation of tetraalkoxytellurane by the condensation of tellurium dioxide with ethylene glycol.

A mixture of commercial grade tellurium dioxide 160 grams, p-toluenesulfonic acid 5 grams, and ethylene glycol 1600 milliliters (ml) were charged into a 2-liter round bottom (RB) flask equipped with a reflux condenser. The contents of the flask were heated and stirred under an argon atmosphere at 120 degrees Centigrade for 3 hours, and then at 160 degrees Centigrade until a clear solution was obtained. This solution was then cooled to room temperature, and allowed to stand on a bench for 5 hours, resulting in the formation of a precipitate of white needles. This precipitate was separated from the mixture by filtration, washed with 100 milliliters (2×50 ml) of cellosolve. These white needles were further purified by recrystallization from a cellosolve solution. The resultant solid, which was obtained in 86 percent yield, and had a purity of 99.999 percent was identified as the tellurium ester tetraalkoxytellurane by known spectroscopic and analytical techniques.

An additional amount of tetraalkoxytellurane can be obtained by concentrating the filtrate resulting from the above-separation processes.

EXAMPLE II

This example describes the conversion of commercial grade selenous acid (94 percent) into diethyl selenite.

A mixture of selenous acid (100 grams), absolute ethanol (200 ml) and benzene (200 ml) was charged to a 1 liter RB flask equipped with a Dean-Stark refluxing column. This mixture was stirred at room temperature under an atmosphere of argon until a clear solution was obtained. The reaction mixture was then slowly refluxed and the water removed azeotropically. About 7 hours were required to complete the reaction to this point. Excess ethanol and benzene were removed by distillation, and the resulting grey residue was distilled under reduced pressure. There was collected 89 grams of a colorless liquid distilling at 68 degrees Centigrade/5 mm. The grey solid residue was again dissolved in a mixture of ethanol (100 ml) and benzene (150 ml). The water was removed azeotropically, and after removing excess ethanol and benzene the residue was fractionally distilled. The fraction distilling at 68 degrees Centigrade/5 mm was collected, and identified as pure, 99.999 percent, diethyl selenite, by infrared, nuclear magnetic resonance (NMR), and confirmed by elemental analysis for carbon, oxygen, and hydrogen. The amount of this fraction was 33 grams, thereby increasing the overall yield of diethyl selenite to 122 grams (91 percent).

EXAMPLE III

This example describes the preparation of bis(arsenic triglycollate) by the condensation of arsenic (III) oxide with ethylene glycol.

A mixture of arsenic (III) oxide 10 grams, p-toluene sulfonic acid 0.1 grams, and ethylene glycol 30 milliliters was charged into a 100 milliliter round bottom (RB) flask fitted with a reflux condenser. The mixture was then stirred at 65 degrees centigrade on a magnetic stirrer under an argon atmosphere. A clear solution was obtained in approximately one hour. The resulting solution was then subjected to a high vacuum distillation, and the fraction distilling at 140–145 degrees centigrade/0.5 mm of mercury was collected. The resulting pure, 99.999 percent, clear liquid, 95 grams, 57 percent yield was identified as bis(arsenic triglycollate) by spectroscopic and analytical analysis.

EXAMPLE IV

In 250 milliliter beaker, 1.8 grams of diethyl selenite, as prepared in accordance with Example II (0.1 moles), 0.06 grams of tetraalkoxytellurane prepared in accordance with Example I (0.0025 moles), and 1 gram of tetrabutylammonium perchlorate were dissolved in 100 milliliters cellosolve. Two electrodes, a ruthenium oxide anode 3×5 cm., and an indium tin oxide cathode were immersed into the above solution, and electrolysis was accomplished at room temperature, about 25 degrees centigrade, with a ECO Model 550 potentiostat/galvanostat. Electroplating of 10 $cm^2$, about 0.07 microns thick films of a $Se_{40}/Te_1$ alloy black in color resulted at the cathode at a current density of 0.5 $mA/cm^2$ for 5 minutes, when a total charge of 755 millicoulombs was passed through the solution.

EXAMPLE V

A 100 milliliter solution of 0.15 moles of diethyl selenite, as prepared in accordance with Example II (1.6 grams) and 0.05 moles of bis(arsenite)triglycollate as prepared in accordance with Example III (1.6 grams) and 100 milliliters of cellosolve were placed in a 250 milliliter beaker. One gram of tetrabutylammonium perchlorate was then dissolved in the solution. Electrolysis was then accomplished by repeating the electrolylis of Example IV, for 5 minutes at current density of 1 $mA/cm^2$. There was consumed by the solution a total charge of 2,955 millicoulombs. There resulted at the cathode a 10 $cm^2$ film of $As_2Se_3$ of a thickness of 0.1 microns.

EXAMPLE VI

The process of Example V was repeated with the expection that 0.6 grams of the tellurium ester of Example I was incorporated into the electrolytic solution, resulting in a deposit of an $As_2Se_{2.7}Te_{0.3}$ alloy.

Electrolysis in accordance with the process of the present invention was accomplished at a temperature of from about room temperature, 20 degrees centigrade, to about 80 degrees centigrade.

Other modifications of the present invention will occur to those skilled in the art based upon a reading of the present disclosure. These are intended to be included within the scope of this invention.

We claim:

1. A process for preparing chalcogenide alloys of high purity which comprises providing a mixture of the corresponding pure esters of the elements desired in an organic medium, and an organic salt, and simultaneously coreducing the esters by an electrochemical reduction in an electrolytic appartus.

2. A process in accordance with claim 1 wherein a mixture of the pure esters of selenium and tellurium are simultaneously subjected to an electrochemical reduction.

3. A process in accordance with claim 1 wherein a mixture of the pure esters of selenium and arsenic are simultaneously subjected to an electrochemical reduction.

4. A process in accordance with claim 1 wherein a mixture of the pure esters of selenium, tellurium and arsenic are simultaneously subjected to an electrochemical reduction.

5. A process in accordance with claim 1 wherein a mixture of the pure esters of selenium, tellurium and sulfur are simultaneously subjected to an electrochemical reduction.

6. A process in accordance with claim 1 wherein the organic medium is selected from cellosolve, glycols, dimethyl sulfoxide, dimethylformamide, or acetonitrile.

7. A process in accordance with claim 1 wherein the organic salt is tetrabutyl ammonium perchlorate.

8. A process in accordance with claim 1 wherein there is present in the electrolytic solution about 100 milliliters of organic solvent and one gram of organic salt to about one to ten grams of a selenium ester or an arsenic ester.

9. A process in accordance with claim 1 wherein there is present in the electrolytic solution about 100 milliliters of organic solvent and one gram of organic salt, to 0.01 gram to one gram of a tellurium ester.

10. A process in accordance with claim 1 wherein the electorchemical reduction is accomplished at a temperature of from about 20 degrees centigrade to about 80 degrees centigrade.

11. A process for the preparation of selenium tellurium, selenium arsenic, or selenium, tellurium, arsenic alloys which comprises subjecting the corresponding pure esters to a simultaneous electrochemical reduction in an electrochemical appartus containing an anode, a cathode, a power source, and an electrolyte solution comprised of the pure esters contained in a solution of tetrabutylammonium perchlorate, and cellosolve, wherein the pure esters lose electrons resulting in the desired metallic alloys.

12. A process in accordance with claim 11 wherein the power source supplies a current density of from about 1 microamper/$cm^2$ to 1 amper/$cm^2$.

13. A process in accordance with claim 11 where the anode materials are selected from carbon, graphite, gold, platnium, steel, nickel, titanium, ruthinized titanium, or indium tin oxide.

14. A process in accordance with claim 11 where the cathode materials are selected from indium tin oxide, tin oxide, carbon, steel nickel, titanium, gold, platnium, palladium, or chromium.

15. A process in accordance with claim 11 where the cathode is comprised of a drum containing aluminum coated with chromium or titanium.

16. A process in accordance with claim 11 wherein there is present in the electrolytic solution about 100 milliters of cellosolve and one gram of tetrabutylammonium perchlorate to about one to ten grams of selenium ester or arsenic ester, or wherein there is present in addition to the selenium ester and the arsenic ester about one gram of tetrabutylammonium perchlorate, to 0.01 gram to one gram of a tellurium ester perabout 100 milliters of cellosolve.

17. A process in accordance with claim 11 wherein the electrochemical reduction is accomplished at a temperature of from about 20° C. to about 80 degrees centigrade.

18. A process in accordance with claim 11 wherein the electrochemical deposition time is from about 12 minutes to about 60 minutes.

19. A process in accordance with claim 11 wherein there results a selenium tellurium alloy.

20. A process in accordance with claim 11 wherein there results a selenium arsenic alloy.

21. A process in accordance with claim 11 wherein there results a selenium arsenic tellurium alloy.

* * * * *